US006335311B1

(12) United States Patent
Namiki et al.

(10) Patent No.: US 6,335,311 B1
(45) Date of Patent: Jan. 1, 2002

(54) LUBRICANT FOR REFRIGERATORS USING AMMONIA REFRIGERANT

(75) Inventors: Masato Namiki; Goro Yamamoto, both of Tokyo; Takashi Kaimai; Hitoshi Takahashi, both of Saitama, all of (JP)

(73) Assignees: Kabushiki Kaisha Japan Energy, Tokyo; Asahi Denka Kogyo K.K., Tokyo, both of (JP)

( * ) Notice: Subject to any disclaimer, the term of this patent is extended or adjusted under 35 U.S.C. 154(b) by 0 days.

(21) Appl. No.: 09/508,961

(22) PCT Filed: Jul. 15, 1999

(86) PCT No.: PCT/JP99/03826

§ 371 Date: Mar. 20, 2000

§ 102(e) Date: Mar. 20, 2000

(87) PCT Pub. No.: WO00/05329

PCT Pub. Date: Feb. 3, 2000

(30) Foreign Application Priority Data

| | | |
|---|---|---|
| Jul. 21, 1998 | (JP) | 10-205162 |
| Oct. 12, 1998 | (JP) | 10-289122 |
| Jun. 18, 1999 | (JP) | 11-172648 |
| Jun. 25, 1999 | (JP) | 11-180051 |

(51) Int. Cl.[7] ..... C10M 145/26; C10M 145/34

(52) U.S. Cl. ..... 508/579; 508/583; 252/68; 568/606; 568/608; 568/613

(58) Field of Search ..... 568/606, 608, 568/613; 252/68; 508/579, 583

(56) References Cited

U.S. PATENT DOCUMENTS

| | | | | |
|---|---|---|---|---|
| 4,061,684 A | * | 12/1977 | Helfert et al. | 260/615 B |
| 4,587,365 A | * | 5/1986 | Anchor | 568/619 |
| 5,595,678 A | * | 1/1997 | Short et al. | 252/68 |
| 5,651,257 A | * | 7/1997 | Kasahara et al. | 62/84 |
| 5,767,324 A | * | 6/1998 | Chaffanjon et al. | 568/621 |

FOREIGN PATENT DOCUMENTS

| | | | |
|---|---|---|---|
| DE | 4404804 A1 | | 2/1994 |
| EP | 0490810 A1 | | 11/1991 |
| EP | 0585934 A1 | | 9/1993 |
| EP | 0699737 A2 | | 8/1995 |
| JP | WO94/12594 | | 11/1992 |
| JP | 5-9483 | * | 1/1993 |

* cited by examiner

*Primary Examiner*—Rosalynd Keys
(74) *Attorney, Agent, or Firm*—Sughrue Mion, PLLC

(57) ABSTRACT

To provide a polyalkylene glycol-based refrigerant oil for refrigerators using ammonia as a refrigerant.

The present invention provides a lubricant for refrigerators using ammonia refrigerant, comprising polyethers selected from the group consisting of a polyether represented by the following general formula (1)

$$X—\{—O—(AO)_n—H\}_p \quad (1)$$

(wherein X is a residue of a monool or polyol from which a hydroxyl group is eliminated; $(AO)_n$ is a polyoxyalkylene group formed by copolymerization of EO and an AO having 3 or more carbon atoms; n is 2 or more; and p is a valence of X) and having 50% or more of secondary hydroxyl groups among the hydroxyl groups located at the terminal of the structure based on the total hydroxyl groups, or a polyether represented by the following general formula (2)

$$X—\{—O—(AO^1)_a—(AO^2)_b—H\}_p \quad (2)$$

(wherein X is a residue of a monool or polyol from which a hydroxyl group is eliminated; $(AO^1)_n$ is a polyoxyalkylene group formed by copolymerization of ethylene oxide and propylene oxide and/or butylene oxide; $AO^2$ is an oxyalkylene group having 3 or more carbon atoms; a is 2 or more; b is 1 or more; and p is a valence of X).

12 Claims, No Drawings

LUBRICANT FOR REFRIGERATORS USING AMMONIA REFRIGERANT

This application is a 371 of PCT/JP99/03826 filed Jul. 15, 1999.

BACKGROUND OF THE INVENTION

1. Field of the Invention

The present invention relates to a lubricant for refrigerators using ammonia refrigerant.

2. Description of the Related Art

Traditionally, compression type refrigerating machines comprise a compressor, a condenser, an expansion mechanism (such as expansion valves) and an evaporator, and chlorine-containing fluorinated hydrocarbons (fluorine compounds) such as trichlorofluoromethane (R11), dichlorodifluoromethane (R12) and chlorodifluoromethane (R22) have been used as refrigerants for a long time. These fluorine compounds have caused the global environmental problem of ozone layer depletion, and so use thereof is restricted, and these compounds have been replaced by chlorine-free fluorine compounds such as difluoromethane (R32), tetrafluoromethane (R134 or R134a) and difluoroethane (R152 or R152a). It has been pointed out, however, that it is very likely that these chlorine-free fluorine compounds also contribute to global warming and are likely to cause environmental problems in the long term.

Accordingly, attention has recently been directed to hydrocarbons and ammonia as refrigerants which would not cause these environmental problems. These refrigerants are superior to the fluorine compounds in terms of compatibility and safety with respect to the global environment and the human body. Moreover, these compounds have been tested over time, although they are not often used as refrigerants.

Heretofore, ammonia has been used only in refrigerators equipped with an oil circulation apparatus at the outlet of the compressor, which separates and collects oil and returns the oil to the inlet of the compressor, because ammonia is not compatible with mineral oils, alkylbenzenes and the like which are refrigerator oils. Also, when such oil circulation apparatus does not function properly, the refrigerator oils are drawn into the refrigeration cycle and cause a shortage of lubricant oil in the compressor, which may result in seizure due to insufficient lubrication at sliding sections and significant reduction in equipment life. Furthermore, since the evaporator is cold, highly viscous refrigerator oils brought in the refrigeration cycle remain in the evaporator and may thereby decrease heat transfer efficiency. Therefore, refrigerators using ammonia have only been used in relatively large industrial devices which receive regular maintenance.

In view of the above-mentioned environmental problems, however, the merits of ammonia refrigerants have been reevaluated. In view of this, refrigerator oils which are compatible with ammonia refrigerant and do not require an oil circulation apparatus, as in the case of fluorine refrigerants, have been proposed. For example, EP Publication No.0490810 discloses lubricants comprising polyalkylene glycols which are copolymers of ethylene oxide (EO) and propylene oxide (PO), wherein EO/PO is 4/1. EP Publication No.585934 discloses lubricants comprising mono- or difunctional polyalkylene glycols, wherein EO/PO is 2/1-1/2. DE Patent Publication No.4404804 discloses polyether-based lubricants represented by the general formula $RO\text{-}(EO)_x\text{—}(PO)_y\text{—}H$ (wherein R is an alkyl group of 1–8 carbon atoms; and x and y are each a number from 5 to 55). Furthermore, EP Publication No.699737 discloses lubricants represented by the general formula $Z\{\text{—}O(CH_2CH(R^1)O)_n\text{—}(CH_2CH(R^1)O)_m\}_p\text{—}H$ (wherein Z has 6 or more carbon atoms in the case of an aryl group and 10 or more carbon atoms in the case of an alkyl group; $R^1$ is H, a methyl group or an ethyl group; n is 0 or a positive number; m is a positive number; and p is a number corresponding to the valence of Z).

Moreover, Japanese Patent Laid-Open No. 5-9483 and WO Publication 94/12594 disclose refrigerator oils comprising polyalkylene glycol diethers which are superior in compatibility with ammonia and have superior stability.

When using the above-mentioned polyalkylene glycol-based compounds as refrigerant oils for a refrigerator with ammonia refrigerant, it has been pointed out that multifunctional polyalkylene glycols having two hydroxyl groups have problems associated with their stability and hygroscopicity. Another problem is that the above-mentioned polyalkylene glycol diethers are less compatible with ammonia than are the polyalkylene glycols having hydroxyl groups, and they are not compatible depending on the structure. Furthermore, the polyalkylene glycol diethers are blocked at the molecular terminal with alkyl groups and have a shortcoming in that this terminal blocking complicates the manufacturing process.

Therefore, it is an object of the present invention to provide a refrigerant oil for refrigerators using ammonia as a refrigerant, which is superior in compatibility with ammonia, lubrication properties, and stability.

SUMMARY OF THE INVENTION

Accordingly, the present invention is a lubricant for a refrigerator using ammonia refrigerant, comprising any one or more of polyethers selected from the group consisting of a polyether represented by the following general formula (1)

$$X\text{—}\{\text{—}O\text{—}(AO)_n\text{—}H\}_p \quad (1)$$

(wherein X represents a residue of a monool or polyol from which a hydroxyl group is eliminated; $(AO)_n$ represents a polyoxyalkylene group formed by copolymerization of ethylene oxide and an alkylene oxide having 3 or more carbon atoms; n is 2 or more; and p is a valence of X) and having 50% or more of secondary hydroxyl groups among the hydroxyl groups located at the terminal of the structure based on the total hydroxyl groups, or a polyether represented by the following general formula (2)

$$X\text{—}\{\text{—}O\text{—}(AO^1)_a\text{—}(AO^2)_b\text{—}H\}_p \quad (2)$$

(wherein x represents a residue of a monool or polyol from which a hydroxyl group is eliminated; $(AO^1)^a$ represents a polyoxyalkylene group composed of copolymerization of ethylene oxide and propylene oxide or butylene oxide; $AO^2$ represents an oxyalkylene group having 3 or more carbon atoms; a is 2 or more; b is 1 or more; and p is a valence of X).

DETAILED DESCRIPTION OF THE INVENTION

In the general formula (1) or formula (2), X represents a residue of a monool or polyol from which a hydroxyl group is eliminated. The monool includes, for example, alcohols such as methanol, ethanol, propanol, 2-propanol, butanol, 2-butanol, pentanol, 2-pentanol, 3-pentanol, isopentyl alcohol, 2-methyl-4-pentanol, hexanol, secondary hexanol, isohexanol, heptanol, secondary heptanol, octanol, 2-ethylhexanol, secondary octanol, isooctanol, nonanol, secondary nonanol, 1-decanol, isodecyl alcohol, secondary decanol, undecanol, secondary undecanol, 2-methyldecananol, lauryl alcohol, secondary dodecanol, 1-tridecanol, isotridecyl alcohol, secondary tridecanol, myristyl alcohol, secondary tetradecanol, pentadecanol, secondary pentadecanol, cetyl alcohol, palmityl alcohol, secondary hexadecanol, heptadecanol, secondary heptadecanol, stearyl alcohol, isostearyl alcohol, secondary octadecyl alcohol, oleyl alcohol, behenyl alcohol, eicosanol, docosanol, tetracosanol, hexacosanol, octacosanol, myricyl alcohol, laccerol, tetratriacontanol, allyl alcohol, cyclopentanol, cyclohexanol, 2-butyloctanol, 2-butyldecanol, 2-hexyloctanol, 2-hexyldecanol, 2-hexyldodecanol, 2-octyldecanol, 2-octyldodecanol, 2-octyltetradecanol, 2-decyldodecanol, 2-decyltetradecanol, 2-decylhexadecanol, 2-dodecyltetradecanol, 2-dodecylhexadecanol, 2-dodecyloctadecanol, 2-tetradecyloctadecanol, 2-tetradecyleicosanol, 2-hexadecyloctadecanol and 2-hexadecyleicosanol; and phenols such as phenol, cresol, ethylphenol, tert-butylphenol, hexylphenol, octylphenol, nonylphenol, decylphenol, undecylphenol, dodecylphenol, tridecylphenol, tetradecylphenol, phenylphenol, benzylphenol, styrenated phenol, and p-cumylphenol.

The polyol includes, for example, diols such as ethylene glycol, propylene glycol, 1,4-butanediol, 1,2-butanediol, neopentylglycol, 1,6-hexandiol, 1,2-octanediol, 1,8-octanediol, isopreneglycol, 3-methyl-1,5-pentanediol, sorbite, catechol, resorcine, hydroquinone, bisphenol A, bisphenol F, hydrogenated bisphenol A, hydrogenated bisphenol F, and dimer diol; trivalent alcohols such as glycerol, trioxyisobutane, 1,2,3-butanetriol, 1,2,3-pentanetriol, 2-methyl-1,2,3-propanetriol, 2-methyl-2,3,4-butanetriol, 2-ethyl-1,2,3-butanetriol, 2,3,4-pentanetriol, 2,3,4-hexanetriol, 4-propyl-3,4,5-heptanetriol, 2,4-dimethyl-2,3,4-pentanetriol, pentamethylglycerol, pentaglycerol, 1,2,4-butanetriol, 1,2,4-pentanetriol, trimethylol ethane, and trimethylol propane; tetravalent alcohols such as pentaerythritol, erythritol, 1,2,3,4-pentanetetrol, 2,3,4,5-hexanetetrol, 1,2,4,5-pentantetrol, 1,3,4,5-hexanetetrol, diglycerol and sorbitan; pentavalent alcohols such as adonitol, arabitol, xylitol and triglycerol; hexavalent alcohols such as dipentaerythritol, sorbitol, mannitol, iditol, inositol, dulcitol, talose, and allose; and octavalent alcohols such as sucrose, polyglycerol, and dehydration-condensates thereof. The value p is a valence of X, preferably 1–8.

X may be a residue of a compound derived from the above-mentioned monools or polyols. The compound derived from the above-mentioned monools or polyols includes sodium alcoholates or potassium alcoholates of the above-mentioned monools or polyols.

For the valence of X, p is more preferably 1–3 because when p is too high for the valence of X, the obtained polyether has too high a viscosity due to an increase in the molecular weight, and compatibility with ammonia refrigerant decreases. In particular, p is most preferably 1, i.e., X is most preferably a residue of a monool from which a hydroxyl group is eliminated. When the carbon number is too high, since compatibility with ammonia refrigerant may decrease even in the case of monools, the carbon number of X is preferably 1–8, more preferably 1–4, and most preferably X is a methyl group.

In the general formula (1), $(AO)_n$ represents a polyoxyalkylene group formed by copolymerization of ethylene oxide and an alkylene oxide having 3 or more carbon atoms. The alkylene oxide having 3 or more carbon atoms includes propylene oxide, butylene oxide, α-olefin oxide, and styrene oxide. Although the polymerization ratio of ethylene oxide and the alkylene oxide having 3 or more carbon atoms is not limited, at least ethylene oxide is essential to impart superior compatibility with ammonia to the polyether which is a polymerizate.

In the general formula (2), $(AO^1)_a$ represents a polyoxyalkylene group formed by copolymerization of ethylene oxide and propylene oxide and/or butylene oxide. Although the polymerization ratio of ethylene oxide and propylene oxide and/or butylene oxide is not limited, at least ethylene oxide is necessary to impart superior compatibility with ammonia to the polyether which is a polymerizate. If the ratio of ethylene oxide is increased too much, however, hygroscopicity and low-temperature properties such as fluid point degrade and powdered solid matter may be deposited or precipitate. Therefore the ratio of the oxyethylene group in $(AO)_n$ or $(AO^1)_a$ is preferably 50 wt. % or less, more preferably 50–10 wt. %, and most preferably 30–10 wt. %. For the same reason, the ratio of the number of the oxyethylene groups in the molecule of the polyether represented by the general formula (1) or the general formula (2) used in the present invention is preferably 40% or less, more preferably 30% or less, and most preferably 20% or less based on the total number of the oxyalkylene groups.

The kind of copolymerization may be random copolymerization, block copolymerization, or a mixture of random copolymerization and block copolymerization. If $(AO)_n$ or $(AO^1)_a$ is a polyoxyalkylene chain totally formed by block polymerization, however, flowability at low temperatures may decrease. Therefore, $(AO)_n$ or $(AO^1)_a$ is in particular preferably a polyoxyalkylene group formed by random polymerization or a polyoxyalkylene group partially containing at least polyoxyalkylene group formed by random polymerization. The subscript a is 2 or more, preferably 2–150, and more preferably 5–100.

$AO^2$ in the general formula (2) represents an oxyalkylene group having 3 or more carbon atoms. The oxyalkylene group having 3 or more carbon atoms includes, for example, an oxypropylene group, an oxybutylene group, and oxyalkylene groups having about 5–24 carbon atoms, and among those, an oxypropylene group or an oxybutylene group is preferred. The subscript b is 2 or more, and is preferably 1–10. In addition, $(AO^2)_b$ is a (poly)oxyalkylene group comprising one or more of the above-mentioned oxyalkylene groups having 3 or more carbon atoms.

The lubricant of the present invention is a polyether represented by the general formula (1) or the general formula (2) and satisfying the above-mentioned conditions, wherein the structural terminal on the opposite side of X is a hydroxyl group. In the polyether represented by the general formula (1) used in the present invention, as for the hydroxyl groups at the structural terminal, the number of secondary hydroxyl groups should be 50% or more based on the total number of hydroxyl groups. Moreover, the number is more preferably 70% or more and most preferably 80% or more. The reason for this is that if the polyether has 50% or more of the secondary hydroxyl groups based on the hydroxyl groups at the structural terminal, it shows excellent stability with ammonia refrigerant; however, if the secondary hydroxyl groups is less than 50%, stability decreases. Incidentally, the secondary hydroxyl group means hydroxyl group connected to secondary carbon atom, and the ratio of the secondary hydroxyl groups can be measured by $^1$H-NMR spectroscopy.

Since the polyether represented by the formula (1) used in the present invention has 50% or more of the secondary hydroxyl groups based on the hydroxyl groups at the structural terminal, it exhibits superior stability with ammonia refrigerant. Similarly, since the polyether represented by the general formula (2) used in the present invention has a group represented by $(AO^2)_b$—H at the structural terminal, it shows superior stability in the presence of ammonia refrigerant.

Generally, a hydroxyl group binding to a primary carbon atom undergoes oxidation to form a carboxylic acid via an aldehyde and the carboxylic acid forms, in the presence of ammonia, an acid amide, which may be deposited. In contrast, a hydroxyl group binding to a secondary carbon atom undergoes oxidation only to form a ketone, which is much stabler in the presence of ammonia than a carboxylic acid. Therefore, it is believed that the polyether represented by the formula (1) or the formula (2) used in the present invention can exhibit superior stability even in the presence of ammonia because 50% or more of the total hydroxyl groups at the structural terminal bind to secondary carbon atoms as in formula (1), or because hydroxyl groups at the structural terminal are bonded to secondary carbon atoms since it is a polyether obtained by adding an alkylene oxide having 3 or more carbon atoms last s as in formula (2).

Accordingly, the lubricant of the present invention solves a problem typical of refrigerants for refrigerators using ammonia refrigerant by selecting a lubricant having a specific structure as described above.

In the lubricant of the present invention for refrigerators using ammonia refrigerant, though any of the polyethers represented by the above-mentioned general formula (1) and the general formula (2) can be used, polyethers which have 50% or more of the secondary hydroxyl groups in the hydroxyl groups located at the structural terminal based on the total number of the hydroxyl groups and which have a structure represented by the general formula (2) are more preferable.

Although the molecular weight of the polyether represented by the formula (1) used in the present invention is not limited, the molecular weight is preferably in the range of approximately 300–3,000 to obtain a kinematic viscosity in a suitable range described below since there is a tendency for molecular weight to be proportional to kinematic viscosity.

Although the kinematic viscosity of the polyether represented by the formula (1) used in the present invention is not limited, sealing properties are poor and lubricating properties may decrease when the kinematic viscosity are too low and compatibility with ammonia decreases and energy efficiency also decline when the kinematic viscosity is too high. Therefore, the kinematic viscosity at 40° C. is preferably 15–200 cSt and more preferably 20–150 cSt.

Ammonia, which is a refrigerant, and the polyether lubricant of the present invention represented by the formula (1) or (2) are preferably used in a weight ratio of 99/1 to 1/99 and more preferably 95/5 to 30/70 in terms of refrigeration ability of the refrigerant and sealing properties of the lubricant.

The polyether represented by the formula (1) or the formula (2) used in the present invention preferably contains as little impurities such as water and chlorine as possible since it is a lubricant for use in a refrigerator with an ammonia refrigerant. Because water accelerates degradation of lubricants, additives and the like, a lower water content is more preferred, and the water content is preferably 500 ppm or less, more preferably 300 ppm or less and most preferably 100 ppm or less. Though polyethers are generally hygroscopic and attention should be given during storage and when loading into a refrigerator, distillation under reduced pressure and passing through a drier filled with desiccant can remove water.

Furthermore, since chlorine forms, in the presence of ammonia, an ammonium salt, which eventually causes clogging of capillaries, a lower chlorine content is more preferable and the chlorine content is preferably 100 ppm or less, and more preferably 50 ppm or less.

Moreover, in the production of the lubricant of the present invention containing oxypropylene groups, propylene oxide may undergo a side reaction to generate an allyl group which has a carbon-carbon double bond. Generation of an allyl group decreases heat stability of the lubricant itself. In addition, an allyl group forms polymers resulting in sludge and forms peroxides due to its susceptibility to oxidation. The peroxides generated decompose into carbonyl groups, which react with ammonia refrigerant to form acid amides, again eventually resulting in clogging of capillaries. In view of the foregoing, lesser degrees of unsaturation originating from the allyl group and the like, are more preferable. Specifically, the degree of unsaturation is preferably 0.05 meq/g or less, more preferably 0.03 meq/g or less, and most preferably 0.02 meq/g or less.

Moreover, the peroxide value is preferably 10 meg/kg or less, more preferably 5 meg/kg or less and most preferably 1 meg/kg or less. A carbonyl value is preferably 100 ppm by weight or less, more preferably 50 ppm by weight or less, and most preferably 20 ppm by weight or less.

It is suitable to react propylene oxide, preferably at 120° C. or less, and more preferably at 110° C. or less, to produce polyethers of the present invention with a low degree of unsaturation. Also, when an alkali catalyst is used in the production, use of inorganic absorbents such as activated carbon, activated clay, bentonite, dolomite, and aluminosilicate can remove the catalyst and hence reduce the degree of unsaturation. Moreover, during the production or use of the lubricant of the present invention, increases in peroxide or carbonyl values can be prevented by avoiding contact with oxygen as much as possible, and by the combined use of antioxidants.

The degree of unsaturation, peroxide values, and carbonyl values are measured by the methods mentioned below according to standard oils and fats analysis tests according to the Japan Oil Chemists Society. A summary of the measurement methods is given below.

Method of Measuring Degree of Unsaturation (meq/g)

A sample is reacted with a Wijs liquid (an ICl-acetic acid solution) and allowed to stand in a dark place, and then excess ICl is reduced to iodine, which is titrated with sodium thiosulfate to calculate the iodine value. The iodine value is converted to a vinyl equivalent to obtain the degree of unsaturation.

Method of Measuring Peroxide Value (meg/kg)

Potassium iodide is added to a sample and the resulting free iodine is titrated with sodium thiosulfate and the amount of free iodine is converted to a milliequivalent per 1 kg of sample to obtain a peroxide value.

Method of Measuring Carbonyl Value (ppm by weigh)

A sample is reacted with 2,4-dinitrophenyhydrazine to form a chromogenic alkynoid ion. The absorbance of the sample at 480 nm is measured and converted to a carbonyl value based on a calibration curve obtained beforehand by using cinnamaldehyde as a standard substance.

Method of producing the polyether represented by the general formula (1) used in the present invention are not limited, and it is suitable to employ usual production methods for polyethers. For example, it is suitable to react an alcohol such as methanol, which is a starting material, with a mixed alkylene oxide of ethylene oxide and an alkylene oxide having 3 or more carbon atoms (e.g., propylene oxide) in the presence of an alkali catalyst such as sodium hydroxide and potassium hydroxide at a temperature of 100–150° C. at a pressure of 0–10 kg/cm$^2$.

Method of producing the polyether represented by the general formula (2) used in the present invention are not limited. For example, it is suitable to react an alcohol, which is a starting material, with a mixed alkylene oxide of ethylene oxide and propylene oxide (or butylene oxide), and then to react the same with an alkylene oxide having 3 or more carbon atoms such as propylene oxide under the similar codition.

Other components may be added to the lubricant of the present invention as necessary. For example, additives such as other known lubricants for refrigerators such as mineral oils, alkylbenzenes, polyalkylene glycol diethers, polyalkylene glycols, polyol esters, and extreme pressure agents such as tricresyl phosphate and triphenyl phosphate; antioxidants such as 2,6-di-tert-butyl-4-methylphenol, 4,4'-methylene-bis-2,6-di-tert-butylphenol, dioctyl diphenylamine, dioctyl-p-phenylenediamine; stabilizers such as phenyl glycidyl ether; oiliness improving agents such as glycerol monooleyl ether and glycerol monolauryl ether; metal deactivators such as benzotriazol; and foam suppressors such as polydimethylsiloxanes are blended as appropriate. Furthermore, additives such as detergent dispersants, viscosity index improvers, anticorrosion agents, corrosion inhibitors, and pour point depressants may be added as necessary. These additives are generally blended in an amount of 0.01–10 wt. % based on the lubricant of the present invention.

EXAMPLES

The following examples illustrate the present invention in more detail. In the examples below, parts and percents are based on weight unless otherwise specified. EO, PO and BO are abbreviations of "oxyethylene group", "oxypropylene group", and "oxybutylene group", respectively, and the symbols "-" and "/" between them represent block copolymerization and random copolymerization, respectively.

(Production Example)

Into a 3-liter autoclave, 64 g of methanol and 8 g of sodium hydroxide as a catalyst were fed. After the catalyst was dissolved, a mixed alkylene oxide of 1,548 g of propylene oxide and 388 g of ethylene oxide (weight ratio 8/2) was reacted at a temperature of 100–150° C. and at a pressure of 0–10 kg/cm$^2$. After aging, 200 g of propylene oxide was reacted a temperature of 100–150° C. and at a pressure of 0–10 kg/cm$^2$ to obtain a lubricant comprising a polyether of Example 1 in Table 1.95 mol % of the hydroxyl groups at the terminal of the polyether were secondary hydroxyl groups and the polyether had an average molecular weight of 1,000 and a kinematic viscosity at 40° C. of 45.3 cSt. Other lubricants of Examples 2 through 14 and Comparative Examples 1 through 4 were produced in the same manner. Structures and characteristics of the lubricants comprising each polyether are shown in Table 1.

Furthermore, the degree of unsaturation, peroxide value, and carbonyl value were measured for all the samples of Examples and Comparative Examples to give degrees of unsaturation of 0.009 meg/g to 0.018 meg/g, peroxide values of 2.5 meg/kg to 3.2 meg/kg, and carbonyl values of 10 ppm by weigh to 15 ppm by weigh. Water content was measured for the samples by using a Karl Fischer moisture determination instrument to yield water contents of 300 ppm or less in all cases.

TABLE 1

| | Structure of polyether | Ratio of secondary hydroxyl group (mol %) | Average molecular weight | PO/EO ratio | Kinematic viscosity 40° C. (cSt) |
|---|---|---|---|---|---|
| Example 1 | $CH_3O$—{(PO)/(EO)}—$(PO)_2$—H | 95 | 1,000 | 80/20 | 45.3 |
| Example 2 | $CH_3O$—{(PO)I(EO)}—$(PO)_2$—H | 95 | 1,000 | 70/30 | 47.5 |
| Example 3 | $CH_3O$—{(PO)/(EO)}—$(PO)_2$—H | 95 | 2,000 | 80/20 | 105.3 |
| Example 4 | $CH_3O$—{(PO)/(EO)}—$(BO)_2$—H | 95 | 1,000 | 80/20 | 44.3 |
| Example 5 | $CH_3O$—{(PO)/(EO)}—H | 90 | 950 | 85/15 | 46.7 |
| Example 6 | $CH_3O$—{(PO)/(EO)}—H | 75 | 900 | 70/30 | 48.3 |
| Example 7 | $CH_3O$—{(PO)/(EO)}—H | 80 | 1,200 | 70/30 | 55.4 |
| Example 8 | $CH_3O$—$(EO)_2$—{(PO)/(EO)}—H | 90 | 950 | 85/15 | 47.7 |
| Example 9 | $CH_3O$—$(PO)_2$—{(PO)/(EO)}—H | 90 | 970 | 85/15 | 48.8 |
| Example 10 | $C_4H_9O$—{(PO)/(EO)}—$(PO)_2$—H | 95 | 1,000 | 80/20 | 45.0 |
| Example 11 | $C_4H_9O$—{(PO)/(EO)}—H | 90 | 940 | 85/15 | 44.6 |
| Example 12 | $CH_3O$—{(PO)/(EO)}—$(PO)_2$—H | 95 | 1,100 | 20/10 | 47.0 |
| Example 13 | HO—(PO)—(EO)—(PO)—H | 95 | 700 | 80/20 | 53.0 |
| Example 14 | G[—O—{(PO)/(EO)}—H]$_3$ | 90 | 600 | 85/15 | 80.5 |
| Comparative Example 1 | $CH_3O$—(PO)—H | 95 | 900 | 100/0 | 47.1 |
| Comparative Example 2 | $CH_3O$—(PO)—(EO)—H | 0 | 1,000 | 70/30 | 46.1 |
| Comparative Example 3 | $C_{12}H_{25}O$—(PO)—H | 95 | 1,000 | 100/0 | 83.0 |
| Comparative Example 4 | $CH_3O$—{(PO)/(EO)}—H | 40 | 1,000 | 35/65 | 51.1 |

In the column "Structure of polyether" in Table 1, {(PO)/(EO)} represents a random copolymerization of propylene oxide and ethylene oxide and {(PO)-(EO)} represents a block copolymerization of propylene oxide and ethylene oxide.

Likewise, G represents a residue of glycerol from which a hydroxyl group is eliminated.

The value in the column "PO/EO ratio" represents a weight ratio in the {(PO)/(EO)} portion in the polyether. For Example 10 and Comparative Example 2, the value is the total weight ratio of PO/EO.

Next, the following tests were conducted on the lubricants of Examples and Comparative Examples in Table 1 to evaluate their suitability as a lubricant for the refrigerant using ammonia refrigerant.

Compatibility with Ammonia

After 5 ml of each sample and 1 ml of ammonia were sealed in a glass tube, the sample was cooled at a rate of 1° C./min from room temperature to determine the temperature at which two-phase separation occurs.

Falex Seizing Load

Falex seizing load was measured according to ASTM-D-3233–73 to evaluate lubricity of each sample.

Cylinder Test

The following tests were conducted to evaluate stability of each sample in an atmosphere of ammonia. Into a 300-ml cylinder loaded with iron wire with a diameter of 1.6 mm as a catalyst, 50 g of each sample was placed and the cylinder was pressurized to 0.6 kg/cm$^2$G with ammonia and further to 5.7 kg/cm$^2$G with nitrogen. Subsequently, the cylinder was heated to 150° C. and kept at that temperature for 7 days. The cylinder was allowed to cool to room temperature and the gas was released to decrease the pressure and ammonia was removed under reduced pressure. Acid values and hues (JIS-K-2580 Determination of ASTM Colors) were measured before and after the test for the samples thus obtained.

Furthermore, the tested samples were transferred to a 100-ml beaker and allowed to stand at room temperature for 5 hours. Subsequently, changes in appearance were visually inspected and evaluated according to the following grades.

0: No abnormality (the same state as before the test)

1: A small amount of powdery precipitate is seen at the bottom of the beaker.

2: Grade between grades 1 and 3.

3: Powdery precipitate is seen all over the bottom of the beaker.

4: Solidified or lost flowability at room temperature. The results of the above-mentioned evaluations are shown in Table 2.

TABLE 2

| | Temperature of two-phase separation (° C.) | Seizing load (Lbf) | cylinder test (before/after) Hue (ASTM) | Acid value (mgKOH/g) | Appearance after test |
|---|---|---|---|---|---|
| Example 1 | −48 | 870 | L0.5/L0.5 | 0.01/0.01 | 0 |
| Example 2 | −49 | 900 | L0.5/L0.5 | 0.01/0.01 | 0 |
| Example 3 | −33 | 920 | L0.5/L0.5 | 0.01/0.01 | 0 |
| Example 4 | −48 | 860 | L0.5/L0.5 | 0.01/0.01 | 0 |

TABLE 2-continued

| | Temperature of two-phase separation (° C.) | Seizing load (Lbf) | cylinder test (before/after) Hue (ASTM) | Acid value (mgKOH/g) | Appearance after test |
|---|---|---|---|---|---|
| Example 5 | −48 | 850 | L0.5/L0.5 | 0.01/0.01 | 0 |
| Example 6 | −50 or less | 850 | L0.5/L0.5 | 0.01/0.02 | 1 |
| Example 7 | −45 | 920 | L0.5/L0.5 | 0.01/0.01 | 1 |
| Example 8 | −49 | 840 | L0.5/L0.5 | 0.01/0.01 | 0 |
| Example 9 | −49 | 840 | L0.5/L0.5 | 0.01/0.01 | 0 |
| Example 10 | −37 | 870 | L0.5/L0.5 | 0.01/0.01 | 0 |
| Example 11 | −43 | 860 | L0.5/L1.0 | 0.01/0.01 | 0 |
| Example 12 | −50 or less | 900 | L0.5/L0.5 | 0.01/0.04 | 1 |
| Example 13 | −50 or less | 820 | L0.5/L0.5 | 0.01/0.01 | 1 |
| Example 14 | −50 or less | 760 | L0.5/L0.5 | 0.01/0.02 | 1 |
| Comparative Example 1 | −28 | 750 | L0.5/L1.0 | 0.01/0.01 | 1 |
| Comparative Example 2 | −46 | 930 | L0.5/white | 0.01/— | 4 |
| Comparative Example 3 | Insoluble at room temp. | 790 | L0.5/white | 0.01/— | 4 |
| Comparative Example 4 | −50 or less | 910 | L0.5/L4.0 | 0.01/0.05 | 3 |

As is apparent from these results, it was demonstrated that the lubricant of the present invention has sufficient lubricity, and at the same time, the temperature of the two-phase separation from ammonia is sufficiently low, showing good compatibility with ammonia and almost no change in hue, acid value, and appearance after the cylinder test was seen, demonstrating superior stability in the ammonia refrigerant system.

An advantage of the invention is the provision of a refrigerant oil for refrigerators using ammonia as a refrigerant, which is superior in compatibility with ammonia refrigerant, lubricating properties, and stability.

What is claimed is:

1. A lubricant for refrigerators using ammonia refrigerant, comprising any one or more of polyethers selected from the group consisting of a polyether represented by the following general formula (1):

$$X—\{—O—(AO)_n—H\}_p \quad (1)$$

wherein X represents a residue of a monool or polyol from which a hydroxyl group is eliminated; $(AO)_n$ represents a polyoxyalkylene group formed by copolymerization of ethylene oxide and an alkylene oxide having 3 or more carbon atoms, and having 50 to 10 wt % of the oxyethylene group in $(AO)_n$; n is 2 or more; and p is a valence of X, and having 50% or more of secondary hydroxyl groups among the hydroxyl groups located at a terminal of the structure based on the total number of hydroxyl groups, or a polyether represented by the following general formula (2):

$$X—\{—O—(AO^1)_a—(AO^2)_b—H\}_p \quad (2)$$

wherein X represents a residue of a monool or polyol from which a hydroxyl group is eliminated; $(AO^1)_a$ represents a polyoxyalkylene group formed by copolymerization of ethylene oxide and propylene oxide and/or butylene oxide; $AO^2$ represents an oxyalkylene group having 3 or more carbon atoms; a is 2 or more; b is 1 or more; and p is a valence of X, and having 50% or more of secondary hydroxyl groups among the hydroxyl groups located at a terminal of the structure based on the total number of hydroxyl groups.

2. The lubricant for refrigerators using ammonia refrigerant according to claim 1, wherein $(AO)_n$ in general formula (1) or $(AO^1)_a$ in general formula (2) is a polyoxyalkylene group formed by random copolymerization of ethylene oxide and propylene oxide and/or butylene oxide, or a polyoxyalkylene group partially containing a polyoxyalkylene group formed by random copolymerization.

3. The lubricant for refrigerators using ammonia refrigerant according to claim 1, wherein a kinematic viscosity of the polyether represented by the general formula (1) or the general formula (2) at 40° C. is 15–200 cSt.

4. The lubricant for refrigerators using ammonia refrigerant according to claim 1, wherein the ratio of the oxyethylene group in $(AO)_n$ in the general formula (1) is 30–10 wt % or the ratio of the oxyethylene group in $(AO^1)_a$ in the general formula (2) is 50–10 wt %.

5. The lubricant for refrigerators using ammonia refrigerant according to claim 1, wherein the degree of unsaturation of the polyether represented by the general formula (1) or the general formula (2) is 0.05 meq/g or less.

6. A method of lubricating refrigerators that use ammonia refrigerant, the method comprising the step of utilizing as a refrigerant oil any one or more of polyethers selected from the group consisting of a polyether represented by the following general formula (1):

$$X—\{—O—(AO)_n—H\}_p \quad (1)$$

wherein X represents a residue of a monool or polyol from which a hydroxyl group is eliminated; $(AO)_n$ represents a polyoxyalkylene group formed by copolymerization of ethylene oxide and an alkylene oxide having 3 or more carbon atoms, and having 50 to 10 wt % of the oxyethylene group in $(AO)_n$; n is 2 or more; and p is a valence of X, and having 50% or more of secondary hydroxyl groups among the hydroxyl groups located at a terminal of the structure based on the total number of hydroxyl groups, or a polyether represented by the following general formula (2):

$$X—\{—O—(AO^1)_a—(AO^2)_b—H\}_p \quad (2)$$

wherein X represents a residue of a monool or polyol from which a hydroxyl group is eliminated; $(AO^1)_a$ represents a polyoxyalkylene group formed by copolymerization of ethylene oxide and propylene oxide and/or butylene oxide; $AO^2$ represents an oxyalkylene group having 3 or more carbon atoms; a is 2 or more; b is 1 or more; and p is a valence of X, and having 5% or more of secondary hydroxyl groups among the hydroxyl groups located at a terminal of the structure based on the total number of hydroxyl groups.

7. The lubricant for refrigerators using ammonia refrigerant according to claim 1, wherein X in the general formula (1) or in the general formula (2) is a monool or a polyol having 1 to 4 carbon atoms.

8. The lubricant for refrigerators using ammonia refrigerant according to claim 2, wherein X in the general formula (1) or in the general formula (2) is a monool or a polyol having 1 to 4 carbon atoms.

9. The lubricant for refrigerators using ammonia refrigerant according to claim 3, wherein X in the general formula (1) or in the general formula (2) is a monool or a polyol having 1 to 4 carbon atoms.

10. The lubricant for refrigerators using ammonia refrigerant according to claim 4, wherein X in the general formula (1) or in the general formula (2) is a monool or a polyol having 1 to 4 carbon atoms.

11. The lubricant for refrigerators using ammonia refrigerant according to claim 5, wherein X in the general formula (1) or in the general formula (2) is a monool or a polyol having 1 to 4 carbon atoms.

12. The lubricant for refrigerators using ammonia refrigerant according to claim 1, wherein the molecular weight of the polyether is in the range of approximately 300 to 3,000.

* * * * *